US005599779A

United States Patent [19]

Karol et al.

[11] Patent Number: 5,599,779

[45] Date of Patent: Feb. 4, 1997

[54] SYNERGISTIC RUST INHIBITORS AND LUBRICATING COMPOSITIONS

[75] Inventors: Thomas J. Karol, Norwalk; Steven G. Donnelly, New Fairfield; Brian W. Stunkel, Stamford, all of Conn.

[73] Assignee: R. T. Vanderbilt Company, Inc., Norwalk, Conn.

[21] Appl. No.: 619,054

[22] Filed: Mar. 20, 1996

[51] Int. Cl.[6] ..... C10M 141/02; C10M 141/06

[52] U.S. Cl. ..... 508/283; 508/284; 508/511; 508/514; 252/342

[58] Field of Search ..... 252/51.5 A, 34, 252/392; 508/283, 284, 285, 511, 514

[56] References Cited

U.S. PATENT DOCUMENTS

| | | | |
|---|---|---|---|
| 2,604,451 | 7/1952 | Rocchini | 252/51.5 |
| 2,644,793 | 7/1953 | Rudel et al. | 252/43.6 |
| 2,790,779 | 4/1957 | Spivack et al. | 252/392 |
| 2,841,555 | 7/1958 | Lyons et al. | 242/33.6 |
| 2,935,389 | 5/1960 | Titsworth et al. | 44/66 |
| 3,116,252 | 12/1963 | Beretvas | 252/51.5 |
| 3,282,836 | 11/1966 | Miller | 508/511 |
| 3,639,240 | 2/1972 | Mutchler | 252/52 R |
| 4,419,253 | 12/1983 | Kennedy et al. | 508/511 |
| 4,420,414 | 12/1983 | Valone | 252/392 |
| 4,435,298 | 3/1984 | Oppenlaender et al. | 252/34 |
| 4,536,311 | 8/1985 | Horodysky | 508/285 |
| 4,582,943 | 4/1986 | Kristen et al. | 508/514 |
| 4,631,139 | 12/1986 | Burton et al. | 508/285 |
| 4,795,581 | 1/1989 | Nieh et al. | 508/511 |
| 5,294,371 | 3/1994 | Clubley et al. | 252/389.23 |
| 5,344,579 | 9/1994 | Ohtani et al. | 508/284 |

*Primary Examiner*—Margaret Medley
*Attorney, Agent, or Firm*—Rasma B. Balodis

[57] ABSTRACT

This invention relates to synergistic rust inhibiting compositions consisting of (a) N-acylsarcosine compound, (b) dicarboxylic acid having 6 to 48 carbon atoms, and (c) an amine selected from primary, secondary or tertiary amines or imidazoline compounds.

Lubricating compositions containing the synergistic rust inhibiting compositions possess good antirust stability.

19 Claims, No Drawings

SYNERGISTIC RUST INHIBITORS AND LUBRICATING COMPOSITIONS

BACKGROUND OF THE INVENTION

The invention concerns lubricating compositions having improved properties. Another aspect of the invention relates to additive compositions which impart rust inhibiting properties to lubricating compositions.

Lubricating compositions coming in contact with metal surfaces must possess not only good lubricating properties, but also good anticorrosion and rust inhibiting properties. Various rust inhibitors and corrosion inhibitors are known in the art.

A known rust inhibitor is N-acylsarcosine which is used in the form of metal salt described in U.S. Pat. No. 2,841,555, further in conjunction with a solubilizing alkyl primary amine described in U.S. Pat No. 2,790,779 or together with diamines disclosed in U.S. Pat No. 2,935,389 and ethylene oxide-rosin amine reaction products in U.S. Pat. No. 3,116,252.

Another known rust inhibitor for hydrocarbon oils is dicarboxylic acid disclosed in U.S. Pat No. 2,644,793 which can be reacted with a primary or secondary amine as disclosed in U.S. Pat. No. 2,604,451. Amine salts of polymaleic acid are described in U.S. Pat. No. 4,435,298.

Surprisingly, it has been discovered that N-acylsarcosines produce a synergistic rust inhibiting effect in lubricating greases when combined with a dibasic acid and certain amines in critical proportions.

SUMMARY OF THE INVENTION

According to the invention, there are provided synergistic rust inhibiting compositions consisting of (1) N-acylsarcosine represented by the structural formula

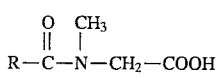

(I)

wherein R represents $C_{8-18}$-alkyl or alkenyl group, (2) a dicarboxylic acid represented by the structural formula $$HOOC(CH_2)_xCOOH \quad \text{(II)}$$

wherein x is an integer from 4 to 46 and (3) an amine selected from the group of compounds having the formula

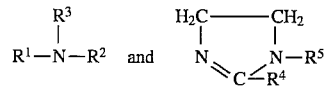

(III) (IV)

wherein $R^1$, $R^2$ and $R^3$ are independently selected from hydrogen, alkyl having up to 14 carbon atoms, hydroxyalkyl, cycloalkyl or polyalkyleneoxy groups; $R^4$ is alkyl or cycloalkyl and $R^5$ is hydroxyalkyl or alkyl, and the molar ratio of the sarcosine to the dicarboxylic acid to the amine is about 2:1:2: to 7:1:2.

Another aspect of the invention concerns lubricating compositions having improved rust inhibiting properties and comprising a major portion of oil of lubricating viscosity, a thickener in an amount to thicken the composition to a grease consistency and a rust inhibiting amount of a rust inhibitor consisting of (1) N-acylsarcosine of structural formula (I), (2) dicarboxylic acid of structural formula (II) and (3) an amine of structural formula (III) or (IV) as defined hereinabove.

DETAILED DESCRIPTION OF THE INVENTION

The rust inhibiting compositions of the invention are composed of known commercially available ingredients which act synergistically as rust inhibitors.

The N-acylsarcosines useful as synergists are $C_{8-18}$-alkyl and alkenyl derivatives. Particularly preferred are fatty acid derivatives, among others, lauroyl sarcosine, cocoyl sarcosine, myristoyl sarcosine and oleoyl sarosine commercially available under the trademark VANSEAL® LS, CS, MS and OS respectively from R. T. Vanderbilt Company, Inc.

The dicarboxylic acid components are dimer acids containing at least 4 carbon atoms and up to 48 carbons or more. The dimer acids are available commercially. Particularly preferred is a dimer acid having 36 carbon atoms available under the trade name Sylvadym® T-22 from Arizona Chemical Company. The commercial dimer acids derived from fatty acids may contain monocarboxylic acids and small amounts of other isomers.

The third component, primary, secondary and tertiary amines of formula III and imidazolines of formula IV, are widely available commercially. Imidazolines of the invention can be substituted by aliphatic groups derived from fatty acids. For example, among others, 2-nor-tall oil-1-hydroxyethyl-4,5-dihydro-1H-imidazoline is available under the trade name Mackazoline® T from the McIntyre Group, Ltd. Amines of the invention have a relatively higher molecular weight. The alkyl-and cycloalkylamines may have a molecular weight ranging from 100 to 350. Polyalkyloxyamines which can be derived from polyethylene oxide and polypropylene oxide have a molecular weight of 80 to 500. Particularly preferred are fatty hydroxyalkylamines and mixed tert-alkylamines having 12 to 14 carbon atoms, commercially available under the trade name Primene® 81R from Rohm and Haas Co.

The three components can be blended in the synergistic molar ratios of about 2:1:2 to 7:1:2 sarcosine to dimer acid to amine. The preferred molar ratio is about 2.3:1:2 to 4:1:2 of sarcosine to dimer acid to amine. Alternately, the dimer acid and the amine can be combined in the molar ratio of 1:2 to form a dimer acid/amine salt and then blended with the sarcosine component in the synergistic proportions described hereinabove. That is, the molar ratio of the sarcosine to the dimer acid/amine salt ranges from about 2:1 to 7:1. The dimer acid/amine salts can be prepared by a neutralization reaction or obtained commercially. For example, N,N-di(2-hydroxyethyl)cocoamine neutralized with a mixture of aliphatic dicarboxylic acid and monocarboxylic acid is available under the trade name VANLUBE® 9011 from R. T. Vanderbilt Company, Inc.

The synergistic compositions may be incorporated in any lubricating media by known methods. The compositions impart rust inhibiting properties to natural and synthetic lubricants. The rust inhibitor is advantageous in formulating certain greases which are particularly difficult to inhibit against rust or ferrous corrosion.

The synergistic compositions may be formulated with oils and waxes into rust preventive compositions for use in automotive and other industries.

The base oils employed as the lubricant vehicles are typical natural and synthetic oils used in automotive and industrial applications such as, among others, turbine oils, hydraulic oils, gear oils, crankcase oils and diesel oils. Natural base oils include mineral oils, petroleum oils, paraffinic oils and the ecologically desirable vegetable oils. Typical synthetic oils include ester-type oils such as pentaerythritol ester, hydrogenated mineral oils, silicones and silanes.

The base oils can be formulated to a grease consistency with various thickening agents such as, among others, silicate minerals as for example bentonite, metal soaps and organic polymers.

The composition of the invention may be incorporated in the lubricant in an amount effective to produce the desired rust inhibiting characteristics. An amount from about 0.05 to 25.0 percent will be sufficient for most applications. A preferred range is from about 0.25 to about 5.0 percent by weight of the total lubricant composition.

The lubricating compositions may contain other conventional additives depending on the intended use of the lubricant. For example, formulations may contain corrosion inhibitors such as 2,5-dimercapto-1,3,4-thiadiazole derivatives, 2-mercaptobenzothiazole and its salts. Other additives include, among others, antiwear agents, antifriction agents, antioxidants, dispersants, detergents and the like.

The following examples are given for the purpose of illustrating the invention and are not intended in any way to limit the invention. All percentages and parts are based on weight unless otherwise indicated.

EXAMPLE 1

A laboratory test was conducted to determine the corrosion preventive properties of lubricating grease compositions of the invention according to the procedure of ASTM D 1743-93.

New, cleaned and lubricated bearings were run under a light thrust load for 60 seconds to distribute the lubricant. The bearings were exposed to water, then stored for 48 hours at about 52° C. and hundred percent relative humidity. After cleaning, the bearing cups were examined for evidence of corrosion and reported as pass (P) or fail (F).

The test samples were prepared by adding the rust inhibitors of the invention to a Bentone base grease, SPEC-LUBE manufactured by Mohawk Co.

The test samples and the results are compiled in Table I. The products referenced in Table I as dimer acid/$C_{12-14}$-tert-alkylamine and dimer acid/imidazoline were prepared by neutralization reaction of a dimer containing 12 carbon atoms with primary $C_{12-14}$-tert-alkylamine (Primene® 81R manufactured by Rohm and Haas) or tall oil alkyl (1-hydroxy-ethyl)-2-imidazoline in 1:2 molar ratio. The product referenced as dimer acid/cocoamine was prepared by neutralization of a mixture of aliphatic $C_{9-12}$dicarboxylic and monocarboxylic acids with N,N-di(2-hydroxyethyl) cocoamine. Dodecyl sarcosine was mixed with the neutralization salt in a molar ratio of sarcosine to the salt ranging from 2:1 to 7:1 as given in Table I.

Samples 3, 4, 5, 6 and 7 containing the synergistic compositions showed good rust inhibition, while samples 1, 2, 8 and 9 containing the individual components or only the dimer acid/amine component failed to give rust inhibiting protection.

The above embodiments have shown various aspects of the present invention. Other variations will be evident to those skilled in the art and such modifications are intended to be within the scope of the invention as defined by the appended claims.

TABLE I

| | Rust Test in Bentone Grease | | | | | | | | |
|---|---|---|---|---|---|---|---|---|---|
| | Test Samples | | | | | | | | |
| Components, Parts by Weight | 1 | 2 | 3 | 4 | 5 | 6 | 7 | 8 | 9 |
| Bentone base grease | 99.50 | 99.50 | 99.50 | 99.50 | 99.50 | 99.60 | 99.60 | 99.60 | 99.60 |
| Lauroyl sarcosine | 0.50 | — | 0.35 | 0.30 | 0.25 | 0.20 | 0.20 | — | — |
| Dimer acid/cocoamine | — | 0.50 | 0.15 | 0.20 | 0.25 | — | — | — | — |
| Dimer acid/$C_{12-14}$-alkylamine | — | — | — | — | — | 0.20 | — | — | 0.40 |
| Dimer acid/imidazoline | — | — | — | — | — | — | 0.20 | 0.40 | — |
| Rust Test | F | F | P | P | P | P | P | F | F |

We claim:

1. A synergistic rust inhibiting composition consisting of (a) N-acylsarcosine represented by the structural formula

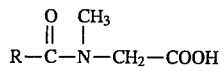

wherein R represents $C_{8-18}$-alkyl or alkenyl group, (b) a dicarboxylic acid represented by the structural formula $HOOC(CH_2)_xCOOH$ wherein x is an integer from 4 to 46, and (c) an amine selected from the group of compounds having the formula

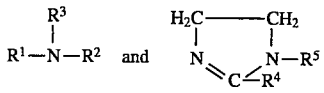

wherein $R^1$, $R^2$ and $R^3$ are independently selected from hydrogen, alkyl having up to 14 carbon atoms, hydroxyalkyl or polyalkyleneoxy groups, $R^4$is alkyl or cycloalkyl and $R^5$ is hydroxyalkyl or alkyl and the molar ratio of the N-acylsarcosine to the dicarboxylic acid to the amine ranges from about 2:1:2 to about 7:1:2.

2. A synergistic rust inhibiting composition according to claim 1 wherein the molar ratio of the N-acylsarosine to the dicarboxylic acid to the amine ranges from about 2.3:1:2 to 4:1:2.

3. A synergistic rust inhibiting composition consisting of (a) N-acylsarcosine represented by the structural formula

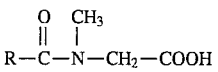

wherein R represents $C_{8-18}$-alkyl or alkenyl group, and (b) an amine salt of a dicarboxylic acid prepared by reacting about one mole of a dicarboxylic acid having the structural formula $HOOC(CH_2)_xCOOH$ wherein x is an integer from 4 to 46 with about 2 moles of an amine selected from the group of compounds having the formula

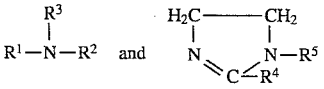

wherein $R^1$, $R^2$ and $R^3$ are independently selected from hydrogen, alkyl having up to 14 carbon atoms, hydroxyalkyl or polyalkyleneoxy group, $R^4$ is alkyl or cycloalkyl and $R^5$ is hydroxyalkyl or alkyl and the molar ratio of the N-acylsarcosine to the amine salt ranges from about 2:1 to 7:1.

4. A composition according to claim 3 wherein the dicarboxylic acid contains monocarboxylic acid.

5. A composition according to claim 3 wherein the salt is prepared from dicarboxylic acid and primary $C_{12-14}$-tert-alkylamine in the molar ratio of 1:2.

6. A composition according to claim 3 wherein the salt is prepared from dicarboxylic acid and tall oil alkyl 1-hydroxyethyl-2-imidazoline in the molar ratio of 1:2.

7. A composition according to claim 3 wherein the dicarboxylic acid contains 12 carbon atoms.

8. A composition according to claim 3 wherein the N-acylsarcosine and the amine salt is in the molar ratio of 2:1.

9. A composition according to claim 3 wherein the amine is a tertiary alkylamine.

10. A lubricating composition comprising an oil of lubricating viscosity and about 0.05 to 25.0 percent by weight of a synergistic rust inhibiting composition consisting of (a) N-acylsarcosine represented by the structural formula

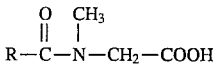

wherein R represents $C_{8-18}$-alkyl or alkenyl group, (b) a dicarboxylic acid represented by the structural formula $HOOC(CH_2)_x$ COOH wherein x is an integer from 4 to 46, and (c) an amine selected from the group of compounds having the formula

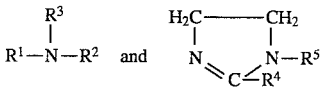

wherein $R^1$, $R^2$ and $R^3$ are independently selected from hydrogen, alkyl having up to 14 carbon atoms, hydroxyalkyl or polyalkyleneoxy groups, $R^4$ is alkyl or cycloalkyl and $R^5$ is hydroxyalkyl or alkyl and the molar ratio of the N-acylsarcosine to the dicarboxylic acid to the amine ranges from about 2:1:2 to about 7:1:2.

11. A lubricating composition according to claim 10 which further contains a thickener.

12. A lubricating composition according to claim 10 wherein the molar ratio of the N-acylsarcosine to the dicarboxylic acid to the amine ranges from about 2.3:1:2 to about 4:1:2.

13. A lubricating composition comprising an oil of lubricating viscosity and about 0.05 to 25.0 percent by weight of a synergistic rust inhibiting composition consisting of (a) N-acylsarcosine represented by the structural formula

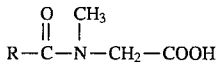

wherein R represents $C_{8-18}$-alkyl or alkenyl group, and (b) an amine salt of a dicarboxylic acid prepared by reacting about one mole of a dicarboxylic acid having the structural formula $HOOC(CH_2)_xCOOH$ wherein x is an integer from 4 to 46 with about 2 moles of an amine selected from the group of compounds having the formula

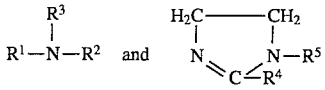

wherein $R^1$, $R^2$ and $R^3$ are independently selected from hydrogen, alkyl having up to 14 carbon atoms, hydroxyalkyl or polyalkyleneoxy groups, $R^4$ is alkyl or cycloalkyl and $R^5$ is hydroxyalkyl or alkyl and the molar ratio of the N-acylsarcosine to the amine salt ranges from about 2:1 to 7:1.

14. A lubricating composition according to claim 13 which further contains a thickener.

15. A lubricating composition according to claim 9 wherein the amine salt is prepared from (1) $C_{9-12}$dicarboxylic acid containing monocarboxylic acid and (2) N,N-di(2-hydroxyethyl)cocoamine in the molar ratio of the acid to the amine of 1:2.

16. A lubricating composition according to claim 13 wherein the amine salt is prepared from dicarboxylic acid and primary $C_{12-14}$-tert-alkylamine in the molar ratio of 1:2.

17. A composition according to claim 13 wherein the salt is prepared from dicarboxylic acid and tall oil alkyl 1-hydroxyethyl-2-imidazoline in the molar ratio of 1:2.

18. A composition according to claim 4 wherein the salt is prepared from (1) $C_{9-12}$dicarboxylic acid containing monocarboxylic acid and (2) N,N-di(2-hydroxyethyl) cocoamine in the molar ratio of the acid to the amine of 1:2.

19. A lubricating composition according to claim 13 wherein the dicarboxylic acid contains monocarboxylic acid.

* * * * *